United States Patent [19]

Zajic et al.

[11] Patent Number: 4,640,767

[45] Date of Patent: Feb. 3, 1987

[54] HYDROCARBON EXTRACTION AGENTS AND MICROBIOLOGICAL PROCESSES FOR THEIR PRODUCTION

[75] Inventors: James E. Zajic, London; Donald F. Gerson, Granton, both of Canada

[73] Assignee: Canadian Patents & Development Ltd/Societe Canadienne des Brevets et d'Exploitation Ltd., Ontario, Canada

[21] Appl. No.: 675,470

[22] Filed: Nov. 29, 1984

Related U.S. Application Data

[63] Continuation of Ser. No. 106,848, Dec. 26, 1979, abandoned, which is a continuation of Ser. No. 872,010, Jan. 24, 1978, abandoned.

[51] Int. Cl.[4] ..... C10G 32/00; C12N 1/20; C12P 21/00

[52] U.S. Cl. ..... 208/390; 166/246; 435/68; 435/101; 435/170; 435/281; 435/843; 435/830; 435/837; 435/872; 435/909; 435/253

[58] Field of Search ..... 435/68, 101, 170, 281, 435/253; 166/246; 252/8.55 D; 208/8 LE, 11 LE, 390

[56] References Cited

U.S. PATENT DOCUMENTS

| | | | |
|---|---|---|---|
| 2,907,389 | 10/1959 | Hitzman | 166/246 |
| 3,340,930 | 9/1967 | Hitzman | 166/246 |
| 3,997,398 | 12/1976 | Zajic et al. | 435/101 |

*Primary Examiner*—Lionel M. Shapiro
*Attorney, Agent, or Firm*—Murray and Whisenhunt

[57] ABSTRACT

Materials of particular utility in separating hydrocarbon values from mineral deposits, e.g. bitumen from tar sands, are prepared by a microbiological fermentation process using certain selected microorganisms. The fermentation process is conducted under aerobic conditions, with the selected microorganisms growing on a hydrocarbon substrate. The materials have surfactant properties, in greater or lesser degree. The materials may be subsequently separated from the fermentation broth, or alternatively the broth may be used as is, since it contains relatively large proportions of suitable separation effecting materials.

8 Claims, No Drawings

HYDROCARBON EXTRACTION AGENTS AND MICROBIOLOGICAL PROCESSES FOR THEIR PRODUCTION

This application is a continuation of Ser. No. 106,848, filed Dec. 26, 1979, now abandoned, which is a continuation of Ser. No. 872,010, filed Jan. 24, 1978, now abandoned.

FIELD OF THE INVENTION

This invention relates to microbially produced hydrocarbon extraction agents, and processes for their preparation, and more specifically to biodegradable extraction aids of microbiological origin, produced by fermentation processes using microorganisms.

BACKGROUND OF THE INVENTION

The need for separation of hydrocarbons, e.g. oil or bitumen, from mineral deposits with which they are found naturally associated, sands and shales, becomes more acute as conventional petroleum resources become depleted. Tar sand formations contain large reserves of hydrocarbons, which can only be exploited if an economical, commercial method of separating the bitumen from the sand is developed. Similarly, secondary oil recovery to extract residual oil from oil bearing formations from which primary, self-energized oil extraction by conventional drilling has been completed, requires an economical separation method.

In the treatment of hydrocarbon bearing mineral deposits such as tar sands, oil shales and other oil-bearing mineral formations, it is possible to effect substantial separation of the hydrocarbon values from the inorganic mineral constituents by washing with cold water containing a synthetic chemical surfactant as extraction aid. This shows promise as a commercially acceptable extraction process in many instances. It avoids the high energy costs associated with the alternative hot water wash processes and steam-drive processes. It also leads to cleaner separations, since it does not alter the surface properties of the clay residue and complicate the settling thereof from the resultant aqueous suspensions, as the hot water processes tend to do. It is however necessary to use a low cost non-toxic, biodegradable and separation-effective surfactant if the cold water process is to be commercially and environmentally attractive.

The production of surface active substances by microbes is well-known. Microbially produced surfactants have chemical structures and properties which are considerably different from those of known, synthetic surfactants. By their very nature, microbially produced surfactants are biodegradable. They also have the potential for cheap production. Some microbially produced surfactants have been reported to have emulsification properties.

BRIEF DESCRIPTION OF THE PRIOR ART

There are a number of prior art references to the production of surfactant materials using microorganisms, and their utilities. For example, U.S. Pat. No. 3,997,398 Zajic and Knettig shows the production of an emulsifying agent by use of a microorganism of species Corynebacterium hydrocarboclastus type UWO419 or NRRL-P-5631. The resultant emulsifying agent is disclosed to be useful in emulsifying hydrocarbon oils in water.

Canadian Pat. No. 234,272 McClure shows a process of separating hydrocarbons from oil bearing sands using a saponaceous reagent such as saponified oil.

U.S. Pat. No. 3,340,930 Hitzman discloses a process in which oil is extracted from an oil bearing stratum by treating the stratum with an aqueous slug of a by-product of an oil fermentation process containing oil, water, salts and live, hydrocarbon-consuming microorganisms of certain yeasts or bacteria. In the process of this patent the live microorganisms themselves must be brought into contact with the oil in the oil bearing stratum, so that they may grow thereon, in order to effect a separating action. The bacteria and yeasts disclosed as useful, however, grow aerobically on hydrocarbons, and the supply of air to the stratum has undesirable effects on the oil present therein. Other patents proposing the use of bacteria for oil recovery, in which the oil in a mineral deposit is treated directly with live microorganisms, are U.S. Pat. No. 3,332,487 Jones; U.S. Pat. No. 2,660,550 Updegraff et al; U.S. Pat. No. 2,907,389 Hitzman; and U.S. Pat. No. 2,413,278 Zobell. A method of processing hydrocarbons and mixtures thereof such as shale oils with microbiological or enzymatic catalysts to reduce the viscosity of the oil is disclosed in U.S. Pat. No. 2,641,566 Zobell.

SUMMARY OF THE INVENTION

It is an object of the present invention to provide microbially derived extraction agents for use in extracting oil values from mineral deposits thereof such as tar sands.

It is a further object of the present invention to provide a method of producing such microbially derived extraction agents, and microbial species and strains for use therein.

It is a further object of the present invention to provide a new and useful method of extracting hydrocarbon values from tar sand and similar bitumen-mineral deposits.

The present invention is based upon the discovery of certain products of microbial fermentation, using specific microorganism types cultivated according to certain growth conditions, which have outstanding effectiveness as extraction agents in bitumen-organic mineral deposits treatments, for separation of the bitumen values therefrom, by cold water washing. Some of the microorganisms which have been found to be useful are known, for other purposes and in other contexts; others are believed to be novel and original.

Thus, in accordance with one aspect of the present invention, there is provided a process for producing extraction agents useful in the separation of hydrocarbon values from mineral deposits, which comprises cultivating by an aerobic fermentation, in a growth promoting medium and under growth promoting conditions, and on a hydrocarbon substrate, a microbial strain of a species of microorganism selected from the group consisting of *Arthrobacter terregens, Arthrobacter xerosis, Bacillus megaterium, Corynebacterium lepus, Cornynebacterium xerosis, Nocardia petroleophila, Pseudomonoas asphaltenicus* and *Vibrio ficheri;* to produce hydrocarbon extraction agent of microbiological origin in said fermentation medium.

According to another aspect of the invention, there is provided an extraction agent useful in separation of hydrocarbon values such as oil and bitumen from inorganic mineral materials associated therewith, said extraction agent being a product of aerobic cultivation, in a growth promoting medium and under growth promoting conditions, and on a hydrocarbon substrate, of a microoganism selected from the group of species consisting of *Arthrobacter terregens, Arthrobacter xerosis, Bacillus megaterium, Corynebacterium lepus, Corynebacterium xerosis, Norcardia petroleophila, Psuedomonas asphaltenicus* and *Vibrio ficheri,* said microorganism being one which is capable of substantial axenic growth by aerobic fermentation on a hydrocarbon substrate.

It will thus be appreciated that the present invention is based upon the discovery of novel extraction agents of microbiological origin, and their use in hydrocarbon deposit treatment. It is thus to be distinguished from previously known processes in which certain live microorganisms have been contacted directly with the hydrocarbon values in the mineral deposits, together with a substrate upon which the microorganism may grow. In such cases, the microorganisms themselves feed upon the oil deposit, consuming a portion thereof in their growth. In the present invention, it is a surfactant product from the growth of the microorganisms, not the live growing microorganisms themselves, which are applied to the oil bearing materials.

This distinction is of considerable practical importance. Firstly, it permits the adjustment of the treatment conditions to those most effective in causing the desired separation of oil values from inorganics, e.g. bitumen from sand. The conditions of treatment, such as temperature, do not have to have regard to the maintenance of the living organisms in an active condition. Secondly, there is no cause to add, along with the microorganisms, other materials to provide a cultivation-promoting environment for the microorganisms. The reduction in requirement for additive salts not only enhances the economics of the process, but also simplifies effluent problems. Thirdly, it permits the utilization of large amounts of existing, known tar sands extraction technology derived from prior experimentation with and use of the cold water extraction process, referred to previously.

Fourthly, most if not all of the microorganisms which will grow on a hydrocarbon substrate require aerobic conditions for growth. The supply of air to in situ oil deposits leads to undesirable oxidative degradation of the oil therein.

The extraction agents of the present invention can be loosely and generally termed surfactants, since, as will appear from the specific examples given below, they will all reduce the surface tension of water to a degree. In point of fact, however, their surfactant properties are very different one from another, ranging from the marginal to the potentially outstanding, in the case of the extraction agent produced using one of the novel microorganisms. The extraction agents of the invention appear to have some other, additional property which is responsible for their efficiency in oil-mineral separation, which does not correlate with their surfactant property. Also some of them appear to have emulsification properties for producing oil in water emulsions, whilst others do not.

DESCRIPTION OF THE PREFERRED EMBODIMENTS

The strains of microorganisms which are useful in the present invention are all capable of axenic growth aerobically, on a hydrocarbon substrate. The useful microorganisms are given in the following Table I.

TABLE I

| Reference No. | Genus | Species | ATCC No. |
|---|---|---|---|
| 1 | Arthrobacter | terregens | 13345 |
| 2 | Arthrobacter | xerosis | 13717 |
| 3 | Bacillus | megaterium | 89 |
| 4 | Corynebacterium | lepus | 11537* |
| 5 | Corynebacterium | xerosis | 373 |
| 6 | Corynebacterium | xerosis | 373 |
| 7 | Corynebacterium | xerosis | 7711 |
| 8 | Nocardia petroleophila | 15777 | |
| 9 | Pseudomonas | asphaltenicus | none |
| 10 | Vibrio | ficheri | 7744 |

*National Collection of Industrial Bacteria (NCIB), Aberdeen, Scotland.

These strains are identified by reference to samples on deposit with the American Type Culture Collection.

Microorganism reference No. 4, namely *Corynebacterium lepus* strain 11537 is believed first isolated by us and not previously disclosed. A viable sample of this culture has been deposited in fulfillment of the requirements of 35USC112 in the National Collection of Industrial Bacteria (NCIB), Torry Research Station, Aberdeen, Scotland, and has been given accession No. 11537.

Microorganism reference No. 9, namely *Pseudomonas asphaltenicus* strain ASPH-Al, is also believed first isolated by us and not previously disclosed. A viable sample of this culture has similarly been deposited in the culture collection of the University of Western Ontario, under reference No. UWO-ASPH-Al.

The desired extraction agents are produced, according to the preferred embodiments of the invention, by aerobic fermentation of one or more of these organisms, in an aqueous salt medium containing appropriate hydrocarbons. Preferably the hydrocarbons are liquid paraffinic hydrocarbons, straight chain or branch chain. Most preferably the hydrocarbons have from about 6 to about 18 carbon atoms per molecule. Mixtures of hydrocarbons, such as kerosene, are suitable.

In general, the microbiological fermentation process is carried out under conditions and using culture medium generally known to those skilled in the art. Aerobic fermentation is essential. Adequate mixing of the culture broth should be undertaken. The technology used is generally similar to that used typically in the industry. The product can be made either by batch or continuous processes in any suitable size of bioreactor. The resulting fermentation broth, containing the desired extraction agent or agents, may be used as a whole for bitumen separation processes, or alternatively the extraction agent or agents may be extracted from the fermentation broth at the end of the microbiological production process, and used in purer form.

Specific examples of extraction agents and processes for their production according to the present invention are given below. Their evaluation as extraction agents in tar sand extraction using water washing is also reported in the following examples.

EXAMPLE 1

The specific microorganisms which are used in the present invention are characterized by their ability to grow axenically on hydrocarbon substrates (purified hydrocarbons, natural petroleum or tar sands) under aerobic conditions at room temperatures (25±3° C.). Some but not all of such microorganisms, according to our invention, produce surfactants of the desired utility as extraction agents in tar sand extraction. The suitable microorganisms were determined by us, in preliminary experiments, by testing samples of soil which contained natural petroleum or refined petroleum products for the presence of suitable microorganisms.

For this purpose, small samples of the hydrocarbon-bearing soils were used to inoculate 50 mls of a mineral salts medium having the following composition per liter of water:

| | | | |
|---|---|---|---|
| $NaNO_3$ | 2.0 g; | KCl | 0.1 g; |
| $K_2HPO_4$ | 1.0 g; | $CaCl_2$ | 0.01 g; |
| $KH_2PO_4$ | 0.5 g; | $FeSO_4.7H_2O$ | 0.01 g; |
| $MgSO_4.7H_2O$ | 0.5 g; | pH | 7.1 |

Incubation continued at room temperature, and through successive transfers, for several months. There were several hundreds of microorganisms present which grew initially, but only a very small number of these were capable of axenic growth (i.e. growth in isolation from other cultures) on the hydrocarbon substrates under these conditions.

In addition, it was observed that some of the cultures which grew axenically in these preliminary experiments caused reductions in the surface tension of the fermentation broth, and in the interfacial tension between the liquid hydrocarbons and the aqueous solutions. These were selected for further testing for the process of the invention. The microorganisms listed in Table I were among those selected.

Surface tensions of the whole fermentation broths were determined using a Fisher Autotensiomat, which is a modified deNuoy surface tensionmeter with a motorized sample stage and a strain gauge which measures tension on the platinum ring. Output is directly in dynes/cm. The platinum ring is pulled upwardly through the aqueous solution, recording a plot of displacement against tension. The maximum tension value on the curve, which is obtained as the ring passes through the liquid surface, is the surface tension value.

The results are given in Table II.

TABLE II

| Culture Ref. (see Table I) | Surface Tension of Whole Broth |
|---|---|
| 1 | 29 dynes/cm. |
| 2 | 58 dynes/cm. |
| 3 | 41 dynes/cm. |
| 4 | 30 dynes/cm. |
| 5 | 30 dynes/cm. |
| 6 | 30 dynes/cm. |
| 7 | 30 dynes/cm. |
| 8 | 65 dynes/cm. |
| 9 | 32 dynes/cm. |
| 10 | 65 dynes/cm. |

The surface tension of water is about 72 dynes/cm., so that the fermentation broths from cultures 2, 8 and 10 show very weak surfactant activity. Most of the others, however, show very pronounced surfactant activity.

Tar sand is a three-phase, three-component system consisting of sand, bitumen and water. On a microscopic scale, separation of bitumen from mineral particles of the tar sand involves manipulation of the interfacial tensions which account for the adhesion between the bitumen and sand and clay. Since the sand and clay particles are at least partially water-wet, as well as being bitumen-wet, the interfacial tensions between water and bitumen, between water and mineral matter, and between bitumen and mineral matter are factors in achieving separation. Reduction in interfacial tensions is thus likely to be a significant feature in tar sand separation. Fermentation broths indicating reduction in surface tension and reduction in interfacial tension, produced in the preliminary experiments from certain microorganisms, were deemed worthy of further investigation as potential aids for tar sand extraction.

EXAMPLE II

In this example, experiments were performed to test the suitability of extraction agents produced microbially using cultures of Table I, for tar sand extraction.

The microbes were grown axenically and under aerobic conditions on kerosene hydrocarbon substrates, until a dense culture formed. Then, portions of the whole fermentation broths were diluted with water to form a 0.02 solution (V/V) of broth, and the solutions applied to sterilized samples of raw Athabasca tar sand, at a ratio of 50 ml solution to 5 g tar sand, at room temperature. The mixtures were gently shaken for 48 hours, and then allowed to settle for 1–3 hours. As a result, there was formed a surface oil fraction, of bitumen cleanly separated from the tar sand and floating on the aqueous surface, an aqueous phase containing, in some cases, small amounts of emulsified bitumen, some separated sand and clay particles, and some residual tar sand, still containing bitumen and inorganic material.

The resulting mixtures were analyzed to determine the weight percent of the total bitumen which was found to be in the floating surface phase in the reaction vessel following treatment with microbial broth (flotation percent), and the weight percent of bitumen in treated, residual tar sand (enrichment), high percentages indicating that high percentages of the mineral matter have been selectively removed from the viscous bitumenous tar sand.

The floating oil was collected with a Whatman GF/A glass fibre filter paper which had been saturated with 1% Siliclad and dried at 105° C. for two hours. These filters are highly hydrophobic, and when placed on the surface absorbed all floating oil largely to the exclusion of water.

The results are given in Table III, with culture reference numbers referring back to Table I.

TABLE III

| Culture reference | Flotation % | Enrichment % |
|---|---|---|
| 1 | 1.4 | 34 |
| 2 | 6.0 | 34 |
| 4 | 3.0 | 40 |
| 5 | 2.5 | 25 |
| 6 | 2.5 | 25 |
| 7 | 2.5 | 25 |
| 8 | 8.4 | 19 |
| 9 | 3.7 | 17 |
| 10 | 2.7 | 18 |
| Control (Water) | 0.6 | 12 |

All the above culture broths thus show greatly enhanced separation ability, as compared with the water control.

Another important characteristic which is desirable in any tar sand extraction process is minimal emulsification of the bitumen by the separating agent. Whilst all of the tested cultures gave broths which were good in this respect, with the possible exception of the broth from *Corynebacterium xerosis* 373 (reference 6), that derived from *Arthrobacter terregens* 13345 (reference 1) was outstanding, and gave no measurable bitumen content in the aqueous phase.

EXAMPLE III

In this example, experiments were performed to determine whether products isolated from fermentation broths prepared by aerobic fermentation of the previously described microorganisms, on hydrocarbon substrates, were capable of effecting separation of bitumen from sand. For this purpose, larger quantities of fermentation broths were produced, by growing 1–10 liters of the microorganisms in the previously described mineral salts medium, along with 4% V/V kerosene, under aerobic conditions and their agitation. Thus the separation agents were extracted from the broth.

The method of extraction differed according to the origin of the fermentation broth. The individual extraction agents appear to differ from one another chemically so that a uniform technique cannot be adopted in all cases. Trial and error experiments were conducted, to determine the best technique in each case. The methods included:

addition of 5 volumes of acetone, to obtain a floating material, followed by rotary evaporation to remove hydrocarbon, water washing and freeze drying;

precipitation with three volumes of ethanol, and air drying of the precipitate;

skimming of floating material from the surface, and freeze drying;

crystallization with ethanol and caustic soda, and collection of crystals and ethanol washing thereof;

filtration of the whole broth through a filter paper to collect ready-formed precipitate;

addition of methanol and acetone, and collection and freeze drying of the floating material so formed;

precipitation by addition of acetone;

centrifugation and collection and freeze drying of the floating material;

acidification of the broth and extraction with chloroform, followed by vacuum drying of the emulsion layer.

Dry powders were obtained in each case. Portions of these products were tested for surfactant ability, by preparing a 0.1% (W/V) solution thereof in water and then testing the resultant mixture for surface tension. Similarly, interfacial tension was measured on similar solutions containing kerosene. Both measurements were accomplished using the Fisher Autotensiomat, described previously. The maximum value of tension on displacement of the platinum ring upwards through a two phase liquid mixture, e.g. water-kerosene, is the interfacial tension of the system.

The results are given in Table IV. The reference numbers for the cultures refer to the listing in Table I.

TABLE IV

| Surfactant from Growth of Culture No. | Surface Tension, dynes/cm. | Interfacial Tension dynes/cm. |
|---|---|---|
| 1 | 50 | 5 |
| 2 | 38 | 5 |
| 3 | 55 | 23 |
| 4 | 45 | 5 |
| 5 | 60 | 10 |
| 6 | 60 | 10 |
| 7 | 60 | 10 |
| 8 | 52 | 15 |
| 9 | 52 | 27 |

Each dry powder was tested for its ability to enhance the separation of bitumen from Athabasca Tar Sand when an aqueous solution at various concentrations from 0.0001% to 0.3% (w/v). In all cases, separation showed a concentration dependence, and at the optimum concentration, substantial bitumen separations from sand were achieved. Results are given in Table V below. The original concentration of bitumen in the tar sand prior to treatment was 10%.

TABLE V

| Culture Ref. No. | Aqueous Concentration (w/v) % | Flotation % | Enrichment % |
|---|---|---|---|
| 1 | 0.02 | 2.0 | 13 |
| 2 | 0.3 | — | 20 |
| 4 | 0.01 | 4.0 | 26 |
| 5 | 0.05 | 5.6 | — |
| 8 | 0.001 | 8.0 | — |
| 9 | 0.0002 | 8.0 | 10 |
| Water Control | | 0.6 | 12 |

EXAMPLE IV

Using the test system described in Example II and the microbial extraction agents described in Example III, experiments were undertaken to determine the combined effect of an organic solvent and a microbial product on the extraction of bitumen and petroleum oils from tar sand. The solvent used was kerosene at a kerosene to bitumen ratio of 0.20:1, and the microbial extraction agents were used in a concentration of 0.2% of the aqueous phase. Tar sand (5 g) was treated with 50 ml of this mixture by gentle shaking at room temperature for 48 hours. Kerosene dissolved bitumen from the tar sand and this mixture floated to the surface of the aqueous phase. More bitumen was present in the surface phase when the solution contained microbial extraction agent, than was present in the surface phase without the use of such extraction agent.

The precise chemical and structural nature of the extraction agents produced according to the present invention is uncertain, and has not been elucidated in detail. It appears that all of the products have a protein content, this varying up to about 44% by total weight, as determined by the Lowry method. Also, all the products appear to have a carbohydrate content, in the range of up to about 22%, as determined by the Anthrone determination. Some of them appear to have high polyphosphate contents also. At the present state of knowledge, however, they can only be characterized as the products of specific fermentation processes using defined microorganisms, as above.

To determine the potential of the products as surface active agents, critical micelle concentrations (CMC) determinations were performed by adding differing amounts of whole fermentation broth containing the extraction agents to water, and measuring the surface tension of the resulting solution. As is well known, a critical micelle concentration is reached when the addition of further surface active material does not cause a further reduction in surface tension of the solution. Thus, the lower the critical micelle concentration, the greater the activity of the added material as a surfactant.

The whole fermentation broth produced from growing microorganism No. 4 of Table I, i.e. *Corynebacterium lepus* 11537, was outstanding in this respect, and showed a critical micelle concentration of approximately 0.033%. This indicates potential utility of this material as a general purpose surfactant of high power. In contrast, the whole fermentation broth from microorganism reference 10 from Table I, *Vibrio ficheri* 7744, gave indications of a critical micelle concentration of the order of 90%, effectively useless as a surfactant material. The fermentation broth from microorganism reference 9, *Pseudomonas asphaltenicus* ASPH-Al gave an anomolous surface tension V concentration curve, with no clearly defined critical micelle concentration, and suggesting that this product may comprise a mixture of two or more different surfactant materials, each having its own, different critical micelle concentration.

We claim:

1. A process for producing extraction agents useful in the separation of hydrocarbon values from mineral deposits, which comprises cultivating by an aerobic fermentation, in a growth promoting medium and under growth promoting conditions, and on a liquid hydrocarbon substrate, a selected microbial strain of a species of microorganism selected from the group consisting of *Arthrobacter terregens, Arthrobacter xerosis, Bacillus megaterium, Corynebacterium lepus, Corynebacterium xerosis, Nocardia petroleophila,* and *Vibrio ficheri;* to produce an extraction agent of microbiological origin in said fermentation medium, subsequently recovering the extraction agent from the fermentation medium and drying said agent to powdered form.

2. The process of claim 1 wherein the microorganism is a strain of *Corynebacterium xerosis* selected from the group consisting of *Corynebacterium xerosis* ATCC 373 and *Corynebacterium xerosis* ATCC 7711.

3. A process for producing an extraction agent useful in the separation of hydrocarbon values from mineral deposits, which comprises cultivating by an aerobic fermentation, in a growth promoting medium and under growth promoting conditions, and on a hydrocarbon substrate, the microorganism *Corynebacterium lepus* NCIB 11537, to produce an extraction agent of microbiological origin in said fermentation medium.

4. The process of claim 1 wherein the microorganism is selected from the group consisting of the strains *Arthrobacter terregens* ATCC 13345; *Arthrobacter xerosis* ATCC 13717; *Bacillus megaterium* ATCC 89; *Norcadia petroleophila* ATCC 15777 and *Vibrio ficheri* ATCC 7744.

5. An extraction agent useful in separation of hydrocarbon values such as oil and bitumen from inorganic materials associated therewith, said extraction agent being a biosurfactant product of aerobic cultivation, in agrowth promoting medium and under growth promoting conditions, and on a hydrocarbon substrate, of the microorganism *Corynebacterium lepus* NCIB 11537 by a process according to claim 3.

6. A process of separating hydrocarbon values from mineral deposits which have hydrocarbon values associated with inorganic materials, which comprises treating said mineral deposits with extraction agents produced by a process according to claim 1.

7. A process of separating hydrocarbon values from mineral deposits which have hydrocarbon values associated with inorganic materials, which comprises treating said mineral deposits with extraction agents produced by a process according to claim 3.

8. A biologically pure culture of *Corynebacterium lepus* NCIB 11357.

* * * * *